United States Patent [19]

Berger et al.

[11] 4,174,738

[45] Nov. 20, 1979

[54] TUBULAR EDGED BELTING AND METHOD OF MAKING

[75] Inventors: Johann Berger; Josef Berger, both of Obere Schlosstrase 114, 7071 Alfdorf, Fed. Rep. of Germany; Konstantin Papageorgion, Urbach, Fed. Rep. of Germany

[73] Assignees: Johann Berger; Josef Berger, both of Aldorf, Fed. Rep. of Germany

[21] Appl. No.: 900,009

[22] Filed: Apr. 25, 1978

[30] Foreign Application Priority Data

Apr. 30, 1977 [DE] Fed. Rep. of Germany ..... 2719382

[51] Int. Cl.[2] ..... D03D 3/00; D03D 5/00

[52] U.S. Cl. ..... 139/384 R; 139/432

[58] Field of Search ..... 139/383 R, 384 R, 385, 139/432, 387; 297/385, 386, 387

[56] References Cited

U.S. PATENT DOCUMENTS

| | | | |
|---|---|---|---|
| 1,995,868 | 3/1935 | Sidebotham | 139/384 R |
| 3,266,529 | 8/1966 | Bunger | 139/384 R |
| 3,550,642 | 12/1970 | Des Rosiers | 139/383 R |
| 3,926,227 | 12/1975 | Takada | 139/383 R |

FOREIGN PATENT DOCUMENTS 2508732 9/1976 Fed. Rep. of Germany .

*Primary Examiner*—Henry Jaudon

*Attorney, Agent, or Firm*—Cushman, Darby & Cushman

[57] ABSTRACT

A belting with a single-layer central portion and two tubular edge portions is made on a needle ribbon weaving machine with one of the tubular edge portions woven as a single layer and then closed to form the tubular edge portion by exerting a pull on the weft thread; a knitting course maintains the tubular edge portion closed along its joint by means of a tuck thread and/or an interlocking thread which is buried in the fabric by feeding a greater length of tuck thread in the knitting course than usual or by laying in the interlocking thread into the head of the knitting needle from vertically above the knitting needle.

4 Claims, 5 Drawing Figures

TUBULAR EDGED BELTING AND METHOD OF MAKING

BACKGROUND AND SUMMARY OF THE INVENTION

The present invention relates to a method and a machine for making belting with a woven single-layer central portion and two tubular edge portions. Beltings of this type are disclosed in German Patent Publication No. 2,508,732. It is an object of the present invention to manufacture this type of belting at a higher speed and therefore at a lower cost than has heretofore been possible.

A belting with two tubular edge portions such as are used in safety belts in vehicles can be woven in a relatively simple manner on a shuttle ribbon weaving machine. However, such machines do not allow high production speeds due to the high mass of the shuttle and the machine elements employed to move the shuttle. Also, the shed formed on such machines is of a relatively large size and a large reed motion is necessary for the shuttle. In addition, much time is consumed for spooling the weft thread for the shuttle.

Utilization of a gripper ribbon weaving machine only slightly increases the production speed for such belts. Although the gripper has a smaller mass than the shuttle, the gripper has a considerable length in relation to the width of the woven belting so as to provide space for the passage of the tuck bobbin. This again results in the formation of a large shed and a large reed motion.

Besides the mass of the gripper, the tuck bobbin must also be moved so that, together, considerable increase in the production speed is prevented. Again, in this type of machine, the tuck thread has to be spooled.

The production speed can be raised considerably by means of the fabric structure of the present invention. According to the present invention, a needle ribbon weaving machine which is known, per se, in this art is utilized where a weft insert needle which is shorter and thinner than the gripper of the gripper machine is employed. Further, this type of machine has a knitting needle with a latch which can be readily employed to fix the weft thread loops formed by the weft inserting needle along one of the belting edges by means of a tuck thread. The tuck thread in such arrangements need not be spooled but can be fed off from a cone or cop.

For making one of the tubular edge portions there is first woven a single-layer fabric which is then closed to form the tubular edge portion in the working sequence immediately after every second double pick of the inserting needle by means of the pull of the associated weft thread. According to the present invention, one of the tubular edge portions is formed in a known manner while the opposite tubular edge portion is manufactured according to the present invention and is located on the side of the belt reached by the inserting needle moving from the first edge portion across the shed to the opposite edge of the belt.

In such structures, a knitting course must be provided at one of the belting edges. However, such knitting courses become worn during the life of the belting and if the belting is used as a safety-belt in vehicles, the edges of the belting rub against the clothes of a person wearing the belt as well as against the shackles of automatic seat belt mounting devices. If the knitting course is destroyed by such wear, the anchoring of the weft thread loops by the tuck thread is lost and the belting would be destroyed. It is especially dangerous, when the belt is used as a safety belt, where the destruction occurs at first only partially as such localized wear is unnoticed so that the resulting decrease in strength of a belt will not be detected.

Generally is also undesirable to have a thick and therefore projecting knitting course since it results in the formation of belting edges which are very rough and can result in discomfort to a wearer. comprises point It is insufficient merely to displace the of course from the medium plane of the belting to there upper or lower attaching line or joint of the second tubular edge portion since the knitting course itself would then be subject to much wear and would abrade against the because of the person reliability and belt. provided in film provide to yield caps film and It is therefore an important object of the especially invention that the foregoing disadvantages be obviated and a strong yet comfortable belting structure that provided. To this end, the tuck thread loops are drawn by the weft loops a certain distance into the central portion of the belt fabric. For example, the tuck thread loops may the resistor drawn a distance of approximately 5 mm within the central portion portion that, the resistive film, for this narrow strip, the weft threads are replaced by tuck threads. This will not change the character of the fabric melted, the react portion of film belt in any practical sense and portion not the film The knitting course will therefore no longer be occupied with the tops or ends of the weft loops and the two ends of the tuck thread loops which are interlocked with an associated end of a weft loop the entire these sections of the threads are displaced into the single-layer central portion of the fabric. As a result, the thickness of the knitting course is considerably reduced and will not project beyond the normal used in of the fabric. Also, oxide soft tubular edge portion will be obtained and the knitting be will not be subjected to any greater wear than the other portions of the belting.

In an alternative embodiment, where it is desired to prevent laddering in the fabric which can destroy the belt, the present invention employs an additional thread, termed a locking thread, which is worked into the knitting course by means of the knitting needle. Following the method of the present invention, even though the use of an interlocking thread renders the knitting course thicker, the knitting course can still be worked into the fabric to a sufficient depth so that it will not noticeably project.

By a further modification, according to the present invention, a normal needle ribbon weaving machine is made suitable for carrying out the method of the present invention by inserting a transmission in the tuck thread feeding device.

Since the single-layer central portion of the belt and the second tubular edge portion have twice the number of tuck threads per meter as compared with the number of weft threads, the tuck thread should be twice as fine as the weft thread. The choice of the weft threads according to the desired characteristics of the belting is therefore limited. In accordance with a further embodiment of the present invention, a belting can be produced without the use of a tuck thread but which retains the above-stated advantageous properties of the belt. According to this embodiment, a pick is always knitted with the preceding pick and with an interlocking thread in making the knitting course. Surprisingly, the knitting course can be inserted easily and with sufficient depth into the belting if the interlocking thread is laid into the head of the knitting needle from a point vertically above, that is, in a downward direction relative to the belt as related to the normal arrangement of a ribbon weaving machine. The single layer ribbon portion which is first made is folded around to the upside and is then drawn onto the central portion. The upper or top-side of the belting is therefore that side on which the single layer ribbon portion for making the tubular edge portion is fixed to the central portion of the belting by means of the knitting course.

Conventional needle ribbon weaving machines do not allow the interlocking thread to be guided above the knitting needle and do not allow the feeding of the interlocking thread from vertically above to the head of the knitting needle. According to the present invention, the needle ribbon weaving machine is improved and made suitable for this type of feeding. In particular, during the necessary rocking motion of the knitting needle with its needle holder, an elastic thread-guide is bent in such a way that the interlocking thread guided by the longitudinal eye is laid into the head of the knitting needle in a correct manner from a point vertically above.

The foregoing and other objects of the present invention will become apparent as consideration is given to the following detailed description taken in conjunction with the accompanying drawings, in which:

DETAILED DESCRIPTION OF THE INVENTION

Figure 1:
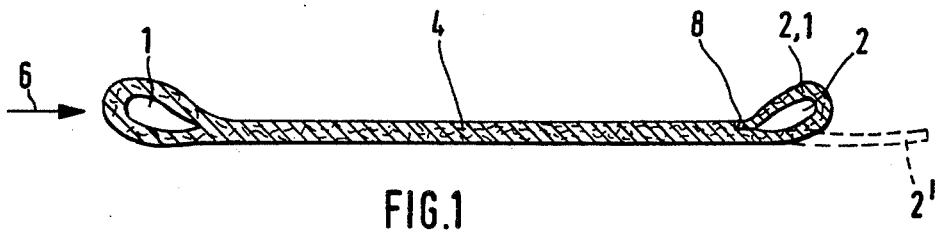
FIG. 1 is a sectional view of a belting structure according to the first embodiment of the present invention.
Figure 2:
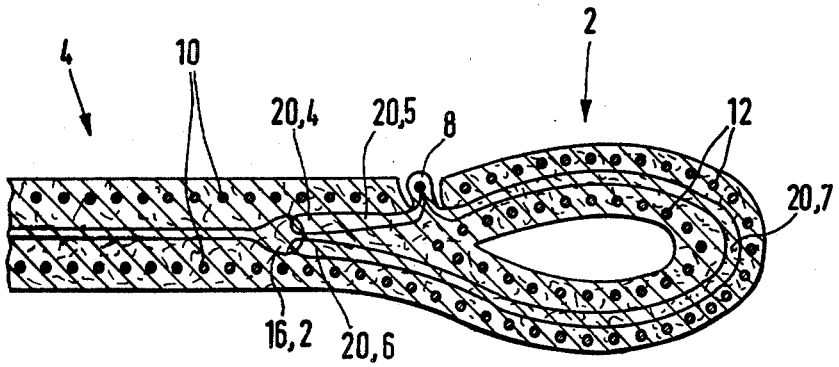
FIG. 2 is an enlarged sectional view of the right-hand tubular edge portion of the embodiment of FIG. 1.

The belting according to FIGS. 1 and 2 has a first tubular edge portion 1, a second tubular edge portion 2 and a single-layer central portion 4. In the weaving operation, the weft inserting needle is moved in the direction of the arrow 6 into the shed here not shown and is returned in the opposite direction. The tubular edge portion 1 is made by a double pick operation in a conventional manner.

For making the second tubular edge portion 2 there is made first a single-layer fabric 2', in the present case by utilizing the ground or main warp threads only. As explained below, when the weft insert needle returns, the fabric is closed to form the second tubular edge portion 2. Simultaneously, a knitting course 8 is made at the joint of the upper fabric layer 2.1 of the tubular edge portion 2 and the right-hand edge 4*a* of the single-layer central portion 4.

FIG. 2 shows schematically the right-hand portion of the belting with the warp threads 10 in the single-layer central portion 4 and the warp threads 12 in the second tubular edge portion 2 in cross-section. As shown, the knitting course 8 is well inserted into the fabric without protruding upwards.

Figure 3:
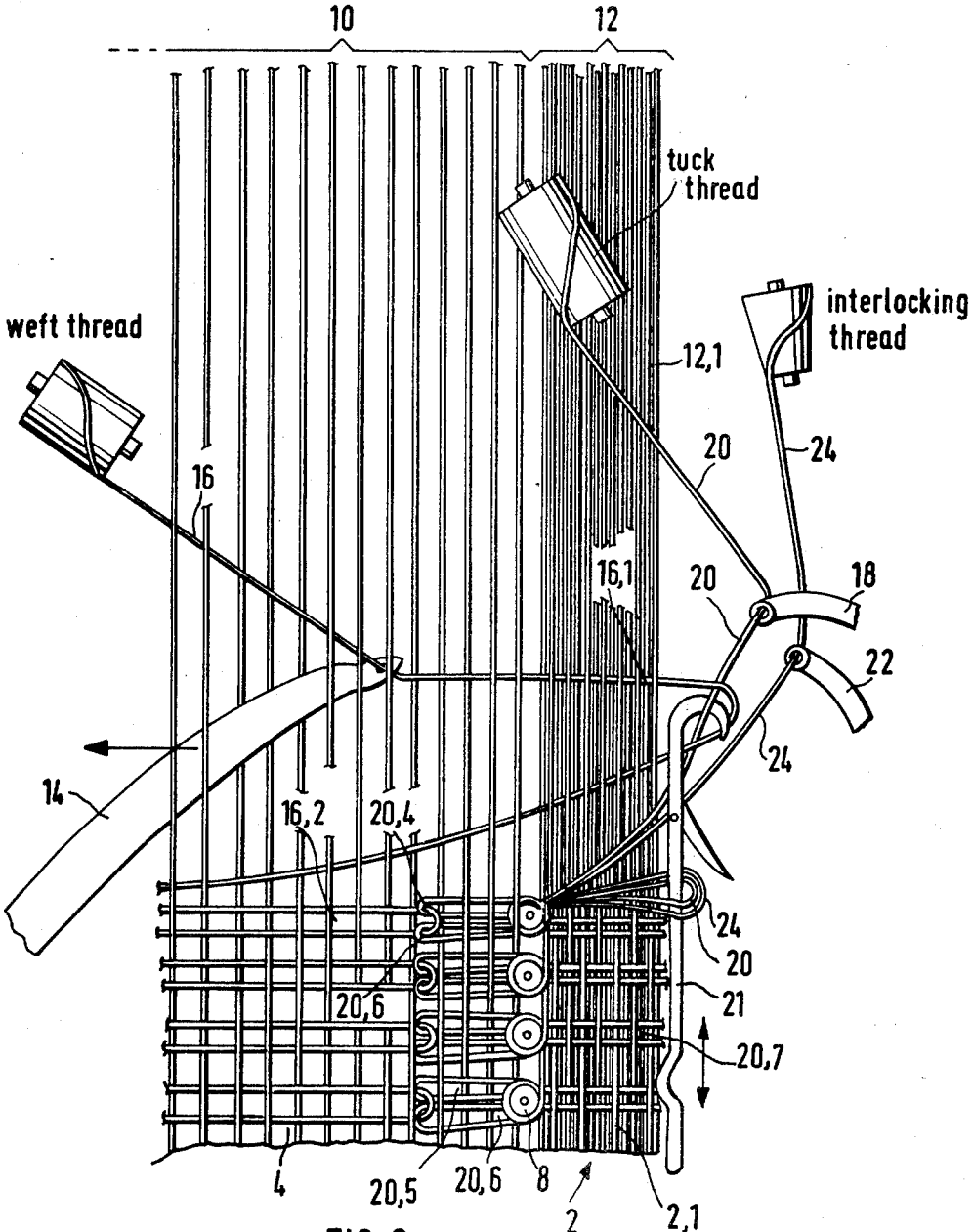
FIG. 3 is a schematic top plan view of a manufacturing step in the production of the belting of FIGS. 1 and 2.

The manufacture of the belting will now be described in detail with reference to FIGS. 2 and 3 showing the second tubular edge portion and the adjacent part of the central portion 4. The fabric of the central portion and of the tubular edge portion are shown in a simplified manner, but it should be understood that the central portion is made in a twill weave and the tubular edge portion in a linen tubular weave.

For making the single-layer central portion, there is provided a group 10 of warp threads of which group only the right-hand portion is shown. For making the second tubular edge portion 2, there are provided warp threads of a group 12 arranged with double density as compared with the warp threads of the group 10. The lower portion of FIG. 3 shows schematically the finished fabric with the second tubular edge portion 2. Only the ground warp threads are utilized for making the second tubular edge so that at first, in the same way as with the central portion 4, a single-layer fabric is produced which later, due to the reed motion of the loom, is drawn around to form the tubular edge portion.

After a shed has been formed, the weft inserting needle 14 is pushed from the left to the uppermost right-hand side through the shed to form a loop 16.1 of the weft thread 16. A tuck thread guide 18 guides the tuck thread 20 through the loop 16.1 of the weft thread and lays the tuck thread into the head of the knitting needle 21 which head is opened at that time. FIG. 3 shows the weft inserting needle 14 while it is returning to the left.

Further an interlocking thread guide 22, which may be attached to the reed, guides the interlocking thread 24 from the knitting course 8 below the knitting needle 21. By an upwards motion of the interlocking thread guide 22, the interlocking thread 24 is laid into the head of the knitting needle 21.

The knitting needle 21 is making stitches 25 out of the weft tuck and interlocking threads and is thus forming the knitting course 8 shown only schematically.

When the inserting needle 14 returns to the left, the weft thread loop 16.1 is drawn to the left and in so doing is taking with it a tuck thread loop which has been made just then from the tuck thread 20. It further draws with it the previous loop 20.2 now knocked-over from the knitting needle 21. By this time two heads 20.4 and 20.6 of tuck thread loops are hanging in the head of the drawn back weft thread loop 16.2 as shown in FIG. 3 for the previous pick. Contrary to the previously known method, there is fed so much tuck thread that, during the reed motion, the two heads 20.4 and 20.6 of the tuck thread loops are drawn by the weft thread loop 16.1 a distance of e.g. 5 mm into the fabric of the single-layer central portion 4. FIG. 2 shows that the tuck thread loop 20.5 extends a short way into the knitting course 8 while the tuck thread loop 20.7 forms the circular edge portion 2 with the warp threads and then also extends into the knitting course 8.

The weft thread loop 16.1 (FIG. 3) is fastened to the outer edge of the first made single-layer fabric 2' (FIG. 1) by means of the tuck thread 20 and the interlocking thread 24. As a consequence, the weft thread draws the single-layer fabric 2' around to form the tubular edge portion 2.

Thus, the knitting course 8 is relieved of the heads of the tuck loops 20.4 and 20.6 and of the heads of the weft thread 16.2. The knitting course, thus unencumbered, disappears in the fabric as shown in FIGS. 1 and 2.

Known needle ribbon weaving machines are feeding the tuck thread at the normal speed which is just sufficient for making a knitting course. Since, according to the invention, much more tuck thread is necessary than in normal cases for making the long tuck thread loops 20.5 and especially 20.7 with every second pick, the tuck thread feeding speed must be increased considerably, e.g. by a factor 4. Therefore a suitable transmission can be built into the tuck thread feeding device. Since a known transmission can be used for this purpose it is not shown in the drawings.

Somewhat less weft thread is needed than in normal cases since the weft thread loops 16.1 are a little shorter than normally. This is achieved by a somewhat smaller feeding speed of the weft thread.

The weft, tuck and interlocking threads are not spooled but run off from cones or cops.

Figure 4:
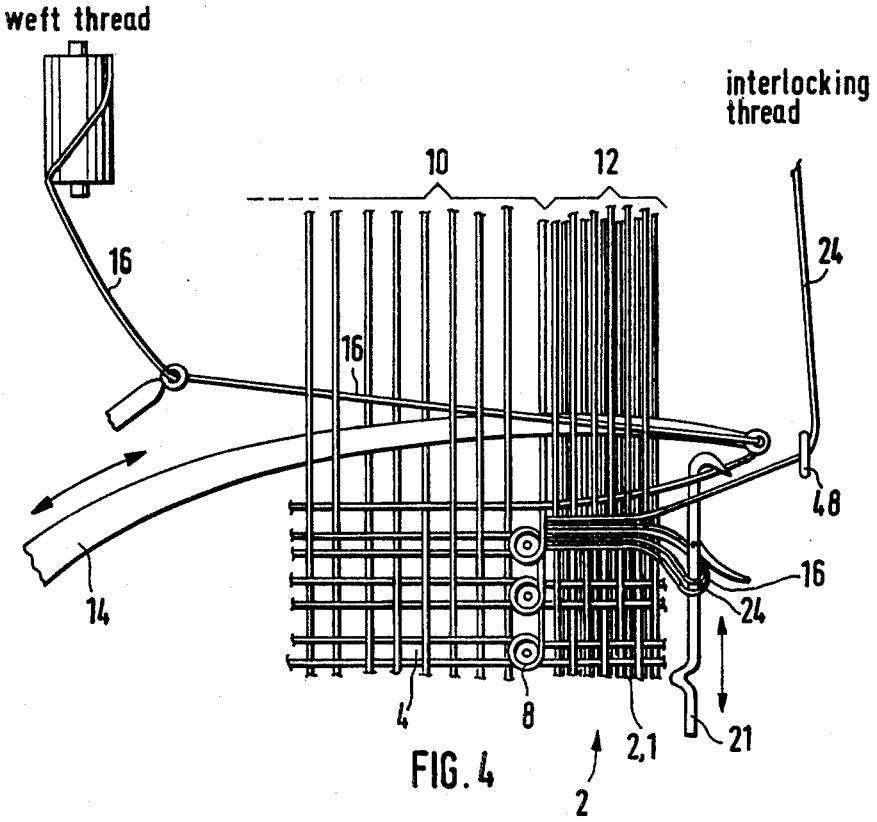
FIG. 4 is a schematic top plan view of the manufacture of belting according to the second embodiment.
Figure 5:
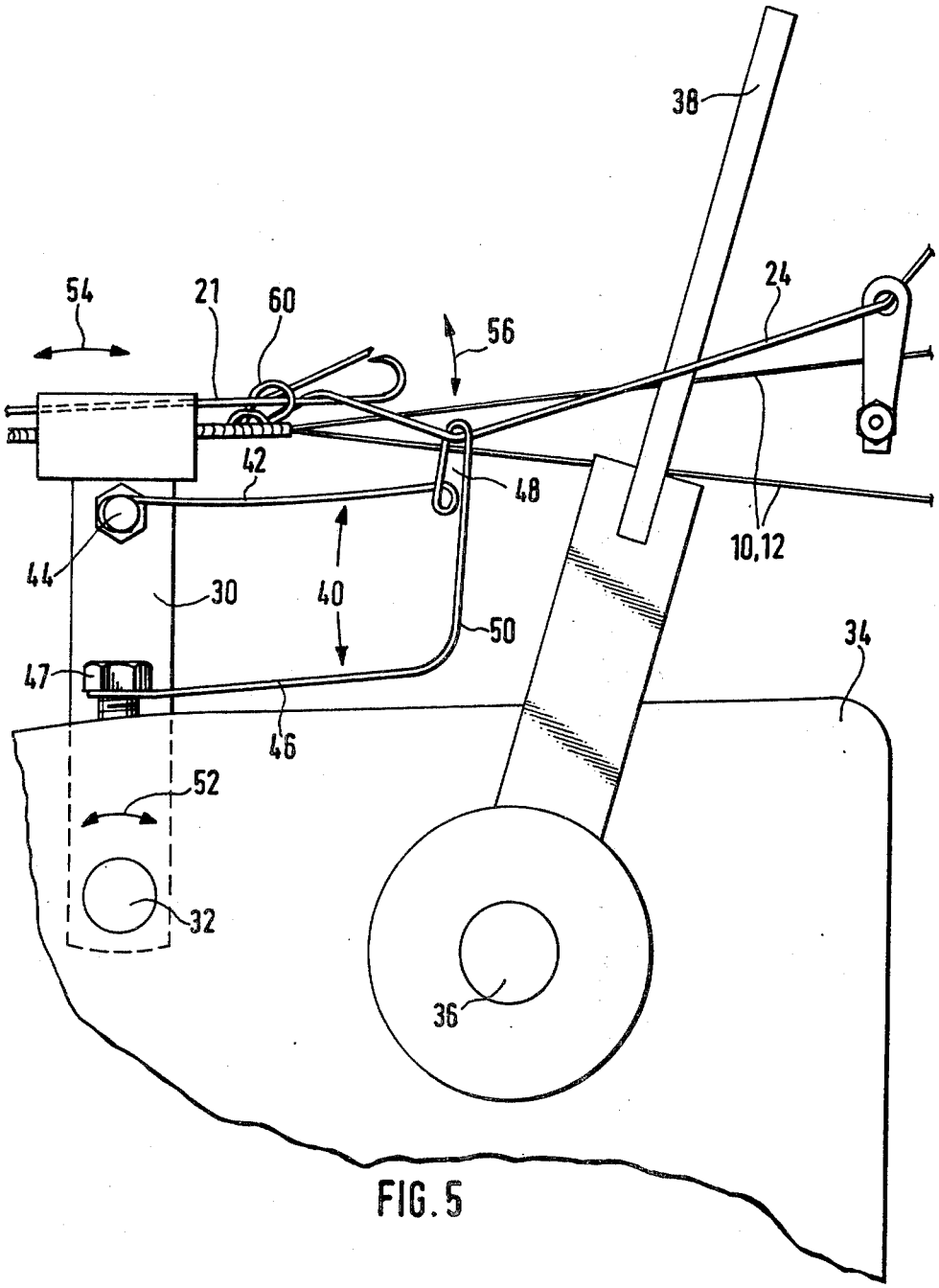
FIG. 5 is a side view of a needle ribbon weaving machine for laying in the interlocking thread in the arrangement of FIG. 4.

In the embodiment according to FIGS. 4 and 5, the weft thread 16 is also making the second tubular edge portion 2 of which only the upper fabric layer 2,1 is shown. A knitting course 8 is made also in this embodiment at the place shown in FIGS. 1 and 2. The knitting course is made ladderproof by knitting in an interlocking thread 24. The head of the knitting needle 21 is directed to the right upper side and has an inclination of about 45 degrees with respect to a horizontal plane, as shown in FIG. 4.

FIG. 5 shows details of the needle ribbon weaving machine as seen from the right-hand side in FIG. 4. The knitting needle 21 is held fast by a needle holder 30 which itself can be rocked about a horizontal axis 32 at the machine frame 34. The reed 38 can be rocked about a second horizontal axis 36 at the machine frame. Both axes 32 and 36 are parallel to each other. FIG. 5 shows also yarns of the groups 10 and 12 of the warp threads.

An interlocking thread guide 40 is provided for laying-in the interlocking thread 24. This thread guide has an upper horizontal arm 42 whose left end is attached to the needle holder 30 and is rotatable about an axis 44. The thread guide 40 has a lower arm 46 whose left end is fastened to the machine frame 34 by a bolt 47. The thread guide 40 is bent from spring steel wire and has a substantially vertical web 50 and at its right upper corner an upright longitudinal eye 48 for guiding the interlocking thread 24.

In operation, the needle holder 30 makes a rocking movement in the direction of the double headed arrow 52 whereby the knitting needle 21 is moved to and fro for about 15 mm in the direction of the double headed arrow 54. During its to and fro motion the needle holder 30 takes with it the upper arm 42 of the interlocking thread guide 30 while the lower arm 46 of the thread guide is fixed to the machine frame. Therefore the thread guide is bent in such a way that the eye 48 makes an up and down movement in the direction of the double headed arrow 56.

In operation of the machine, the inserting needle 14 (see FIG. 4) is advanced to the right-handed side through the open shed while the knitting needle 21 is moving to the upper side of FIG. 4 which is the right-hand side in FIG. 5. The inserting needle lays the weft thread 16 into the open head of the knitting needle 21. The interlocking thread 24 runs from the knitting course 8 above the knitting needle 21 to the eye 48 of the interlocking thread guide. When the eye 48 is lowered, the interlocking thread guide is laid into the then open head of the knitting needle. FIG. 5 shows a later phase of the operation when the knitting needle 21 is returning again to the left and the previous stitch 60 is about to close the latch of the knitting needle 21 and to be knocked over.

The first made single-layer fabric 2' (FIG. 1) is drawn around to form the second tubular edge portion when the weft thread 16 is drawn back while the inserting needle 14 is returning to the left in FIG. 4.

Laying-in the interlocking thread 24 from above leads to the desired result that the knitting course 8 is drawn deeply into the fabric of the central portion 4 and does not project upwards.

What is claimed is:

1. A method of making belting on a ribbon band weaving machine having knitting means, said belting having a woven central portion and first and second tubular edge portions each on one edge of said central portion, comprising the steps of:

(a) forming the first tubular edge portion with warp and weft threads, (b) first weaving the second tubular edge portion as a single layer fabric, having an outside edge, (c) knitting a course defining a joint along the edge of said central portion and said outside edge with two loops of a tuck thread each having a head held by one pick loop of the weft thread and a neck held by the knitting course, and (d) closing the second tubular edge portion by pulling the said one pick loop of the weft thread while feeding a length of tuck thread more than sufficient to form said joint and correspondingly less weft thread.

2. The method as claimed in claim 1 including the step of knitting in the knitting course an interlocking thread to render the knitted course resistant to laddering.

3. A method of making belting on a ribbon band weaving machine having knitting means, said belting having a woven central portion and first and second tubular edge portions each on one edge of said central portion, comprising the steps of:

(a) forming said first and second tubular edge portions with warp and weft threads, (b) first weaving the second tubular edge portion as a single-layer fabric, (c) knitting a course defining a joint along the edge of said central portion and said outside edge with two loops of a tuck thread each having a head held by one pick loop of the weft thread and a neck held by the knitting course, (d) closing the second tubular edge portion by pulling the said one pick loop of the weft thread, and (e) feeding an interlocking thread from the knitting course of the knitting means and laying the interlocking thread into the knitting means from a point spaced vertically above the knitting means.

4. Belting having a woven central portion and first and second tubular edge portion each on one edge of said central portion, said first tubular edge portion being formed with warp and weft threads in the form of a loop, said second tubular edge portion having an outside edge which is knitted by a course defining a joint along the edge of said central portion with two loops of a tuck thread each having a head held by one pick loop of the weft thread and a neck held by the said knitting course with said second tubular edge portion having its outside edge attached to said adjacent edge of said central portion by pulling the said one pick loop of the weft thread while feeding a length of tuck thread more than sufficient to form said joint and correspondingly less weft thread.

* * * * *